United States Patent [19]

Chadwick

[11] Patent Number: 4,886,557

[45] Date of Patent: Dec. 12, 1989

[54] MAGNESIUM ALLOY

[76] Inventor: Geoffrey A. Chadwick, Winchester 12 St. Giles Close Hampshire, England

[21] Appl. No.: 192,271

[22] Filed: May 10, 1988

[51] Int. Cl.[4] ..... C22F 1/06; C22C 23/04

[52] U.S. Cl. ..... 148/3; 148/161; 420/411

[58] Field of Search ..... 420/411, 412; 148/3, 148/13, 161, 406, 420

[56] References Cited

U.S. PATENT DOCUMENTS 4,239,535 12/1980 King et al. ..... 420/411

OTHER PUBLICATIONS

Linberg, "Process and Materials of Manufacture-2nd edition," Allyn and Bacon, Inc. Boston, MA, 1977, pp. 298-301.

Allen, "Metallurgy. Theory and Practice", American Technical Society, Chicago, 1969, p. 404.

*Primary Examiner*—Robert McDowell

*Attorney, Agent, or Firm*—Cushman, Darby & Cushman

[57] ABSTRACT

The invention relates to a magnesium alloy particularly useful for squeeze casting containing 10 to 25% zinc, 0.5 to 5% copper and 0.25 to 4% silicon, the balance being magnesium and aluminum being substantially absent from the alloy. Additions may include up to 1% calcium with a preferred 0.3% calcium, and 0.002 to 0.005% beryllium. The preferred composition is 12% zinc, 1% copper, 1% silicon, balance magnesium, although 0.3% calcium is a preferred addition to this alloy.

The alloy is particularly useful for squeeze casting of automotive and aerospace components.

12 Claims, No Drawings

MAGNESIUM ALLOY

This invention relates to a magnesium alloy.

An object of the invention is to produce a magnesium alloy for applications at elevated temperatures up to about 200° C. It is desired to produce an alloy which has high tensile strength and good fatigue properties not only at room temperatures but also at temperatures as high as 200° C. At the same time the alloy, to be commercially viable, needs to be relatively inexpensive and to avoid exotic and expensive alloy additions such as silver and yttrium.

A further object of the invention was to produce an alloy which is particularly adapted for use in squeeze casting although it may also be used for other applications such as high pressure diecasting and gravity casting. Such an alloy is very useful in the production of automotive and aerospace components especially components of low reciprocating mass.

Squeeze casting is a casting process in which metal is solidified under the direct action of a pressure sufficient to prevent the appearance of either gas or shrinkage porosity. Squeeze casting is unique in this respect, all other casting processes leave some residual porosity. While this process has been known for many years, its adoption as a commercial process has been hampered by the lack of suitable alloys. An alloy in accordance with this invention is designed to be and is particularly useful in a squeeze casting process.

By consideration of the microstructure of the alloy and by extensive experiment and testing the present invention has been arrived at.

According to the present invention there is a magnesium alloy containing the following constituents by weight, apart from impurities:

| | |
|---|---|
| zinc | 10 to 25% |
| copper | 0.5 to 5% |
| Silicon | 0.25 to 4%, |

the balance being magnesium, and aluminium being substantially absent from the alloy.

Preferably the magnesium alloy contains:

| | |
|---|---|
| zinc | 11 to 20% |
| copper | 0.5 to 2.0% |
| silicon | 0.25 to 2.5% |

A further preferred range of constituents of a magnesium alloy according to the invention is:

| | |
|---|---|
| zinc | 11 to 15% |
| copper | 0.8 to 1.5% |
| silicon | 1.0 to 2.0% |

The alloy may include up to 1% calcium.

A preferred amount of calcium is 0.3% calcium.

The alloy may include 0.002 to 0.005% beryllium.

A particular preferred alloy contains 12% zinc, 1% copper, 1% silicon and the balance magnesium apart from any incidental impurities. Preferably, 0.3% calcium is included.

The alloy is preferably heat treated by solutionising, water quenching and ageing.

The solutionising should take place at a maximum of 430° C. for a maximum of 24 hours.

Ageing should be at a maximum of 220° C.

The magnesium alloy may be used for example for squeeze casting, for which its properties are eminently suitable, and for the production of components for automotive or aerospace use.

Compared with alloys according to the present invention, known magnesium alloys such as MEL's ZM61 containing 6% zinc and 1% manganese, and MEL ZCM 711 containing 7% zinc, 1% copper and 1% manganese, although having a high tensile strength and good fatigue properties at room temperature have poor creep properties at elevated temperatures.

To increase the creep properties at elevated temperatures, in accordance with the present invention, it is necessary for the alloy system to form stable intermetallic compounds at the grain boundaries to stop them from sliding.

By increasing the zinc content compared with the above-mentioned known alloys the precipitate for basic mechanical strengthening is provided and the basis for forming magnesium/zinc intermetallics.

Addition of copper is made to grain refine and to generate a uniform distribution of fine precipitates. Excess amounts of copper beyond those in accordance with this invention resulted in the presence of magnesium/copper intermetallic compounds which are deleterious. Silicon is added in accordance with this invention and has very low solubility in magnesium. The small amount of silicon added formed magnesium silicon intermetallic compounds during solidification.

In accordance with the present invention melts were prepared from pure magnesium, copper, zinc and silicon. The magnesium was melted and the copper added and then the silicon was added in small crushed pieces wrapped in copper foil. A plunger was used to push through the melt and kept in the melt for a period. The melt was maintained at 730° C. for approximately four hours to dissolve the silicon. The zinc was added last. The melt was kept under a protective atmosphere of SF6 plus $CO_2$ all the time. Before pouring the cover was removed for the melt to be skimmed and stirred to bring up the heavier zinc from the bottom of the crucible.

In one alloy preparation in accordance with the invention a 12% zinc, 1% copper, 1% silicon ingot was poured at 700° C. and solidified under a pressure of 100 MPa.

Four further compositions were prepared and cast into cylindrical ingot casting as follows:

1. 15% zinc, 1% copper, 1% silicon—density 1.986 g/cc.
2. 12% zinc, 1% copper, 1% silicon—density 1.936 g/cc.
3. 9% zinc, 1% copper, 1% silicon—density 1.890 g/cc.
4. 6% zinc, 1% copper, 1% silicon—density 1.840 g/cc.

In the casting of the 15.1.1 alloy (No. 1 above) owing to the higher zinc content and subsequently lower freezing temperature a lower pouring temperature of 650° C. was used.

To confirm a suspected effect of the pouring temperature and/or the cooling rate between turning off the heating and reaching the pouring temperature on the morphology of $Mg_2Si$ alloy 2 was prepared and cast at 650° C.

This enabled us to confirm that with a lower pouring temperature the morphology of $Mg_2Si$ changes from a fine-armed "Chinese script" structure in the case of the high pouring temperature to a more lumpy angular structure in the case of a lower pouring temperature.

Alloy 3 was prepared and cast with a pouring temperature 680°-690° C. In microstructure of the resultant casting a combined angular and Chinese script $Mg_2Si$ structure is present but the amount of $Mg_2Si$ is very small.

A further alloy was prepared similar to alloy 2 above but with the addition of 0.3% calcium.

The alloys prepared were then tested in a conventional manner for creep resistance and tensile properties.

Table 1 indicates the time to reach various percentages creep strain from 0.1 to 0.5 under a loading of 100 MPa at a temperature of 150° C.

Table 2 is a similar table with a loading of 50 MPa at 180° C. Tables 3 and 4 illustrate at room temperature and at 180° C. the tensile properties. Table 5 compares the tensile properties of a 12-1-1 alloy with and without 0.3% calcium addition.

Tables 6 and 7 compare the number of cycles to failure at specific loading of the five alloys respectively at room temperature and at 180° C.

Table 8 is a table of creep data or a preferred alloy, that is to say one with 12% zinc, 1% copper, 1% silicon, balance magnesium.

Where there are gaps in the results, for instance in the 6.1.1. composition which is used to compare alloys within the invention with one which is clearly outside the scope of the claims, the omission of the results is simply because there is no measurable result achievable. For instance, in Table 1 the 6.1.1. alloy reached 0.1% creep strain in a time which was too small to be measured which indicates in fact that its creep properties at 150° C. under 100 MPa are so poor as to make the alloy of no value in use for example in squeeze casting.

All of the alloys produced in accordance with this invention are heat treated before use, the heat treatment cycle preferably involving solutionising at a maximum of 380° C. for 24 hours, water quenching, and ageing at 185° C. for 10 hours. The ageing could be carried out up to about 220° C. with a reduction in time to say 4 hours. Alloys in accordance with the present invention are easy to melt and to cast and can be produced under and SF6 atmosphere in air whereas prior art alloys require the use of SF6 in $CO_2$.

Furthermore no grain refinement is necessary with alloys in accordance with this invention because the alloy is finished with a very fine grain size. In squeeze casting the alloy does not result in porosity or cavities being formed.

TABLE I

| (wt %) COMPOSITION | | | | 150° C./100 MPa TIME IN HOURS TO REACH A CREEP STRAIN | | | | |
|---|---|---|---|---|---|---|---|---|
| Zn | Cu | Si | Ca | 0.1 | 0.2 | 0.3 | 0.4 | 0.5 |
| 9 | 1 | 1 | | 0.15 | 0.47 | 1.3 | 3.3 | 6.0 |
| 12 | 1 | 1 | | 0.25 | 5.6 | 17 | 36 | 70 |
| 12 | 1 | 1 | +0.3 | 4 | 13 | 60 | 130 | 250 |
| 15 | 1 | 1 | | 0.17 | 1.7 | 5.5 | 11 | 19 |

TABLE 2

| (wt %) COMPOSITION | | | | 180° C./50 MPa TIME IN HOURS TO REACH A CREEP STRAIN | | | | |
|---|---|---|---|---|---|---|---|---|
| Zn | Cu | Si | Ca | 0.1 | 0.2 | 0.3 | 0.4 | 0.5 |
| 6 | 1 | 1 | | 0.3 | 5 | 20 | 62 | 150 |
| 9 | 1 | 1 | | 0.7 | 9 | 36 | 110 | 260 |
| 12 | 1 | 1 | | 15 | 150 | 430 | 1100 | 2400 |
| 12 | 1 | 1 | +0.3 | 30 | 200 | 700 | 1700 | 3700 |
| 15 | 1 | 1 | | 4 | 62 | 300 | 850 | 2000 |

TABLE 3

| COMPOSITION (WT %) | | | | ROOM TEMPERATURE TENSILE PROPERTIES | | |
|---|---|---|---|---|---|---|
| Zn | Cu | Si | Ca | UTS | 0.2% PS | % E |
| 9 | 1 | 1 | | 244 | 157 | 4 |
| 12 | 1 | 1 | | 221 | 162 | 2.6 |
| 12 | 1 | 1 | +0.3 | 239 | 201 | 1 |
| 15 | 1 | 1 | | 238 | 213 | ≦1 |

TABLE 4

| COMPOSITION (wt %) | | | | AT 180° C. TENSILE PROPERTIES | | |
|---|---|---|---|---|---|---|
| Zn | Cu | Si | Ca | UTS | 0.2% PS | % E |
| 6 | 1 | 1 | | 176 | 118 | 8.4 |
| 9 | 1 | 1 | | 172 | 147 | 9.7 |
| 12 | 1 | 1 | | 184 | 171 | 7.1 |
| 12 | 1 | 1 | +0.3 | 196 | 186 | 8.7 |
| 15 | 1 | 1 | | 203 | 176 | 9.5 |

TABLE 5

| COMPOSITION (wt %) | | | | TEN-SILE | TEST TEMPERATURE | | | |
|---|---|---|---|---|---|---|---|---|
| Zn | Cu | Si | Ca | PROP. | RT | 100 | 150 | 180 |
| 12 | 1 | 1 | | UTS | 221 | TEST RESULTS NOT AVAIL. | 183 | 167 |
| | | | | 0.2% PS | 162 | TEST RESULTS NOT AVAIL. | 130 | 100 |
| | | | | % E | 2.6 | TEST RESULTS NOT AVAIL. | 3.4 | 7.1 |
| 12 | 1 | 1 | +0.3 | UTS | 239 | 205 | 201 | 196 |
| | | | | 0.2% PS | 201 | 175 | 174 | 170 |
| | | | | % E | 1 | 4.3 | 5.6 | 8.7 |

TABLE 6

| (wt %) COMPOSITION | | | | ROOM TEMPERATURE CYCLES TO FAILURE AT SPECIFIC LOADING | | | |
|---|---|---|---|---|---|---|---|
| Zn | Cu | Si | Ca | $5 \times 10^4$ | $5 \times 10^5$ | $5 \times 10^6$ | $1 \times 10^7$ |
| 6 | 1 | 1 | | 128.3 | 83.2 | 67.0 | 65.0 |
| 9 | 1 | 1 | | | | | |
| 12 | 1 | 1 | | 131.1 | 90.2 | 73.3 | 70.5 |
| 12 | 1 | 1 | +0.3 | 148.1 | 115 | 100 | 98.7 |
| 15 | 1 | 1 | | 145.2 | 105 | 74.7 | 71.9 |

TABLE 7

| (wt %) COMPOSITION | | | | 180° C. CYCLES TO FAILURE AT SPECIFIC LOADING | | | |
|---|---|---|---|---|---|---|---|
| Zn | Cu | Si | Ca | $5 \times 10^4$ | $5 \times 10^5$ | $5 \times 10^6$ | $1 \times 10^7$ |
| 6 | 1 | 1 | | 84.6 | 57.8 | 54.3 | 52.9 |
| 9 | 1 | 1 | | 129.1 | 84.6 | 66.3 | 63.5 |
| 12 | 1 | 1 | | 114.4 | 66 | 53.6 | 52.2 |
| 12 | 1 | 1 | +0.3 | 129.7 | 90.2 | 73.3 | 69.8 |

TABLE 7-continued

| (wt %) COMPOSITION | | | | 180° C. CYCLES TO FAILURE AT SPECIFIC LOADING | | | |
|---|---|---|---|---|---|---|---|
| Zn | Cu | Si | Ca | $5 \times 10^4$ | $5 \times 10^5$ | $5 \times 10^6$ | $1 \times 10^7$ |
| 15 | 1 | 1 | | 129.1 | 84.6 | 66.3 | 63.5 |

TABLE 8

| TESTING CONDITION | | TIME TO REACH % CREEP STRAIN HRS. | | | | |
|---|---|---|---|---|---|---|
| TEMP °c. | STRESS MPa | 0.1 | 0.2 | 0.3 | 0.4 | 0.5 |
| 50 | 150 | 8 | 85 | 280 | 900 | 2800 |
| 100 | 100 | 4.5 | 130 | 600 | 1800 | 4700 |
| 150 | 100 | 0.25 | 5.5 | 17 | 35 | 64 |
| 180 | 50 | 15 | 150 | 380 | 800 | 1500 |

I claim:

1. A magnesium alloy containing the following constituents by weight, apart from impurities:

| | |
|---|---|
| zinc | 11 to 25% |
| copper | 0.5 to 5% |
| silicon | 0.25 to 4% |

the balance being magnesium, and aluminium being substantially absent from the alloy.

2. A magnesium alloy according to claim 1 and containing

| | |
|---|---|
| zinc | 11 to 20% |
| copper | 0.5 to 2.0% |
| silicon | 0.25 to 2.5%. |

3. A magnesium alloy according to claim 1 and containing

| | |
|---|---|
| zinc | 11 to 15% |
| copper | 0.8 to 1.5% |
| silicon | 1.0 to 2.0%. |

4. A magnesium alloy according to claim 1 and including up to 1% calcium.

5. A magnesium alloy according to claim 4 and including 0.3% calcium.

6. A magnesium alloy according to claim 1 and including from 0.002 to 0.005% beryllium.

7. A magnesium alloy containing 12% zinc, 1% copper, 1% silicon and the balance magnesium apart from any incidental impurities.

8. A magnesium alloy according to claim 7 and containing 0.3% calcium.

9. A method of heat treating a magnesium alloy containing the following constituents by weight, apart from impurities:

| | |
|---|---|
| zinc | 11 to 25% |
| copper | 0.5 to 5% |
| silicon | 0.25 to 4% |

the balance being magnesium, and aluminum being substantially absent from the alloy, which comprises solutionizing, water quenching and ageing the magnesium alloy.

10. A method of heat treating a magnesium alloy according to claim 9 in which the solutionising takes place at a temperature up to and including 430° C. for a time period up to and including 24 hours.

11. A method of heat treating a magnesium alloy according to claim 10 wherein the ageing takes place at a temperature up to and including 220° C. for about 8 hours.

12. A method for producing a manufactured article which comprises squeeze casting and heat treating a magnesium alloy containing the following constituents by weight, apart from impurities:

| | |
|---|---|
| zinc | 11 to 25% |
| copper | 0.5 to 5% |
| silicon | 0.25 to 4% |

the balance being magnesium, and aluminum being substantially absent from the alloy wherein the heat treating comprises solutionizing, water quenching and aging the magnesium alloy.

* * * * *